United States Patent [19]

Carpenter, Jr.

[11] Patent Number: 4,861,940

[45] Date of Patent: Aug. 29, 1989

[54] AUTOMATED MOISTURIZED GROUNDING ELECTRODE SYSTEM

[76] Inventor: Roy B. Carpenter, Jr., 6687 Arapahoe Rd., Boulder, Colo. 80303

[21] Appl. No.: 241,253

[22] Filed: Sep. 7, 1988

[51] Int. Cl.[4] ..... H01R 4/66

[52] U.S. Cl. ..... 174/6

[58] Field of Search ..... 174/6, 7

[56] References Cited

FOREIGN PATENT DOCUMENTS 105411 4/1917 United Kingdom ..... 174/7

*Primary Examiner*—Laramie E. Askin

[57] ABSTRACT

A grounding electrode which is automatically moisturized from a solar powered humidifier that produces the required moisture through solar radiation to which it and its component parts are exposed. The generation of moisture is therefore a function of the available sunlight, the thereby radiated heat and the soil dryness. A unit operating on utility power is also described.

4 Claims, 1 Drawing Sheet

AUTOMATED MOISTURIZED GROUNDING ELECTRODE SYSTEM

BACKGROUND

In the desire to attain grounding interfaces having low resistance, various systems and equipment configurations have been developed. It seems, however, that the available choice of such systems is in inverse proportion to the usefulness of any one of those means.

The major reason for the inadequacy of those arrangments appears to be the absence of proper soil conditions, that is adequate moisture and minerals and, especially, one that does not degrade with time. In addition thereto, an automated process such as, for example, automated mineral or moisture enhancement of a said soil conditioning would constitute a further improvement.

To the applicant's knowledge based on his considerable experience in this domain, no devices having the aforementioned desirable and necessary characteristics are available at the time of this writing.

SUMMARY OF INVENTION

This invention consists in principle of a grounding electrode protected by a well assembly cover and an automatically performing moisture control unit, hydraulically connected with the former. A system of the described general nature can be solar-controlled, or timed and moisture-sensor-controlled operating on local power, where available. Either variety can be equipped with various additional sensing elements depending on the respective locations, soil characteristics and users' specifications without affecting the applicant's basic concept of his improvement.

Moisture contents is seemingly the single most influential factor in grounding systems. Without it, there is no effective soil contact. It is this medium that forms the electrolyte in the soil and brings about the true conductive character of that soil. It is firmly believed that no conventional grounding system exists that will function satisfactorily, or at all, in, for example, dry desert areas without specialized treatment.

It is, therefore, evident that some form of moisturization system is mandatory. For this purpose, the Lightning Eliminators and Consultants (LEC), Inc., a manufacturer of lightning protection equipment in Boulder, Colo., has provided a, by all appearances proprietary, "Chem-Rod" grounding electrode system with, likewise, an original automated moisture control, so that the earth interface hemisphere can also be kept above the required moisture level and that for any possible situation. To accomplish this, moisture is injected directly into the grounding electrode in the form of a mist to provide the minimum of moisture required for a given area.

The actual installations of systems in accordance with the concept of this improvement outlined in the foregoing should further be tailored according to the following factors:

(a) the state and the variations within the soil in question;

(b) trade-off studies between the various grounding electrode types, dimensions and orientations;

(c) the impact of seasonal meteorological variations;

(d) seasonal resistivities; and (e) moisture enhancements.

Because the nucleus of this improvement, namely, the automated moisturing feature and system, can practically be considered an independent entity for connection to and in combination with already existing equipment, it will be treated alone with only superficial reference to units served by it.

Further advantages of the subject improvement per se, over prior art and over possible relation with individual and unexpected applications, will become more apparent from the following description and the accompanying drawing.

In the drawing, forming a part of this application:

FIG. 1 is an isometric view of the system equipment operating on solar power, constituting this invention, complemented by an isometric pictorial illustration of a possible and typical equipment location with respect to structures in the landscape and FIG. 2 is a schematic presentation of a system and its equipment operating on local utility power and water source.

DETAILED DESCRIPTION

Figure 1:
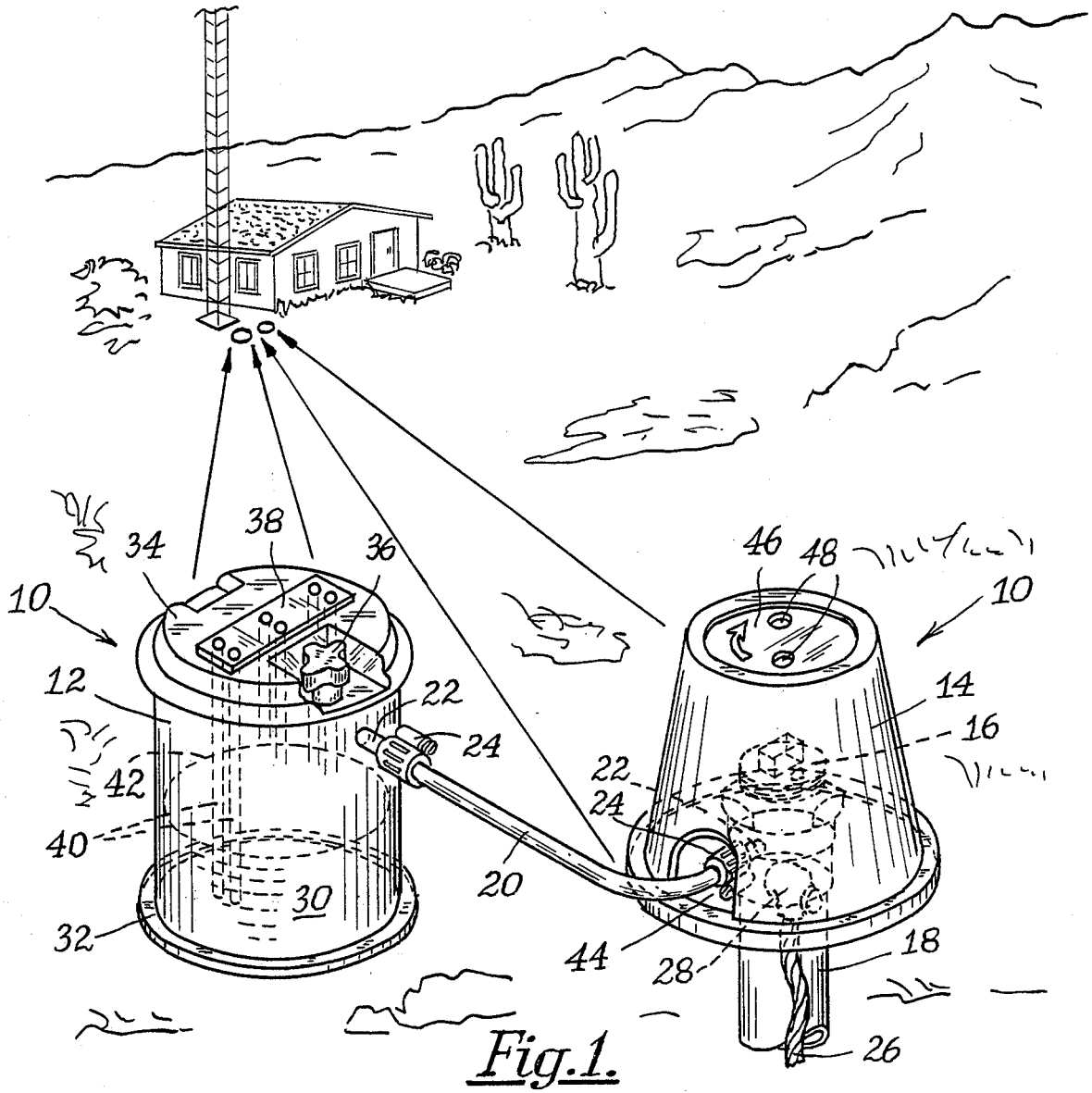

Referring now to the drawing, wherein like reference numerals designate like or corresponding parts and, more particularly, to FIG. 1, therein is portrayed a typical automated moisturizing grounding electrode equipment 10 which consists, in this case, of the solar humidifier 12 and the access-well-enclosure 14, the latter covering and thereby protecting the exposed top 16 of, in this example, a vertically buried grounding electrode 18. A hydraulic line formed from a conventional pipe or tubing 20 is mounted at one of its two ends to said solar humidifier 12 by means of unions 22 and hose clamps 24 and at its other end to said grounding electrode 18 in a like manner, thereby accomplishing the connection between said solar humidifier 12 and said grounding electrode 18. The electric connection wire 26 which originated at a point of the grounded structure (in the background of the pictorial landscape) is shown at its termination 28 on the grounding electrode 18.

The solar humidifier 12 consists, for example, of a cylindrical housing 30 having a solid bottom 32 and a top 34, the latter having a removable threaded filler cap 36 positioned within a recess of said top 34 and a heat sink 38 mounted on the flat top portion of the housing top 34. The heat sink 38 carries at least one heat conductor 40 (only two are shown in the drawing, FIG. (1) mounted in a downward direction and reaching into the fluid 42, thereby conducting heat from the atmosphere and the solar radiation into said fluid 42 and thusly aiding the moisturizing effect of the entire system arrangement. The required fluid 42 is filled into the housing 30 upon the removal of said threaded filler cap 36, which is then replaced.

The access well enclosure 14 is substantially a downwardly-open shell of a durable material capable of withstanding adverse environmental and soil conditions. It has a port 44 through which the pipe 20 passes and a removable top lid 46 to allow for the observation and possible servicing of the exposed top 16 of the grounding electrode 18. For the convenience of negotiating the top lid 46, say, two finger holes 48 are formed therein.

If desired, or required, especially for systems operating on external power and water sources, a fluid level sensor (not shown) can be included and mounted, for example, on the top 34 but extending into the fluid 42 to a level which is considered critical for the respective system operation. The fluid level sensor will cause an alarm at a control station for remedial action, should the fluid level position call for it. Also, a previously mentioned timing instrument can be readily included within these controls. Additional specific sensing and alarm systems, both power line and battery operated, selectively, are available in the trade to suit system designers' and users' requirements alike.

The operation of this entire system may be self-explanatory on the basis of the foregoing detailed description of the component parts and their assemblies. Upon the filling of the solar humidifier 12 with a fluid 42, both these items become exposed to the heat radiated from and by the sun and that contained in the atmosphere, changing the fluid, however gradually, into a mist, which, in turn, travels through the pipe 20 to the top 16 of the grounding electrode 18 causing the moisturizing of the chemicals contained in said grounding electrode 18 and their release into the ambient earth. It is apparent that the rate of this transformation process is a function of the dryness of the soil and of both the presence and the potency of the sunlight striking the solar humidifier 12 and the heat sink 38 with which the heat conductors 40 are connected. If a fluid level sensor may be used, it will alert the user of the need for fluid refill. The aforementioned fluid may be water or a chemical solution of a specialized composition, depending on operating conditions, but without affecting the herein described equipment performance.

Figure 2:
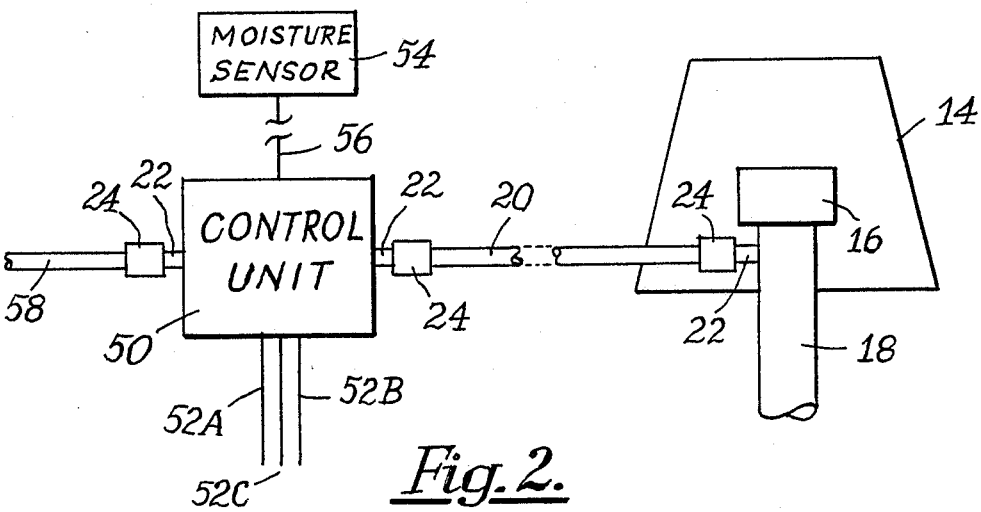

The earlier mentioned moisture sensor controlled version of an automated moisturized grounding electrode and system operating on local utility power is shown in FIG. 2. The component parts identical with those of the system shown in FIG. 1 are the access well enclosure 14, the exposed grounding electrode top 16, the grounding electrode 18, and the pipe 20 feeding the fluid 42 to the grounding electrode 18 as well as the unions 22 and the hose clamps 24.

The control unit 50 receives its operating power through the conductors 52A, 52B and, for three-phase operation, the conductor 52C. A moisture sensor 54 is connected with its leads 56 (only one is shown symbolically) to the appropriate terminals of the control unit 50, which is likewise shown in symbol. A fluid supply pipe 58 is installed at, for example, a valve (not shown) located in the interior of the control unit 50, said valve being controlled according to the need for replacement of said fluid.

It becomes apparent that upon the sensing of moisture, or of its absence, the moisture sensor causes the activation of a valve in the control unit providing a fluid flow to the grounding electrode until the available moisture causes the response of the moisture sensor to close this fluid valve. An arrangement of this kind may obviate the need for a fluid level indicator, although a sensor reporting a failure in the fluid supply line may be called for.

It should be noted that most, if not all, component parts enumerated in reference to FIG. 2 are commercially available in the trade. It is their believed to be novel calibrations, individual as well as their joint response settings and their correlated operation, which result in the innovative effects of these teachings.

It is understood that the herein shown and described embodiments of the subject invention are but illustrative and that variations, modifications and alterations are feasible within the spirit of these teachings.

I claim:

1. Apparatus for forming a grounding system for providing an electrical interface with the soil for various electrical and lightning protection systems, comprising:

a grounding electrode for extending into the soil;

means attached to the grounding electrode for connecting a pipe to the grounding electrode;

a solar humidifier having a watertight container for containing water;

said watertight container comprising means for adding water thereinto;

said watertight container further comprising a top having a solar energizable heat sink;

said heat sink including heat conductors which extend downward into the inside of the watertight container for transforming water into a mist;

said watertight container further comprising a pipe near its top connected to the means for connecting a pipe to the grounding electrode for conducting moisture to the grounding electrode.

2. The apparatus of claim 1, wherein the solar humidifier further comprises a water level sensor for indicating the need to add water to the watertight container of the solar humidifier.

3. A grounding system for providing an electrical interface with the soil for various electrical and lightning protection systems, comprising:

a grounding electrode extending into the soil;

means attached to the grounding electrode for connecting a pipe to the grounding electrode;

an underground solar humidifier having a watertight container containing water;

said watertight container comprising means for adding water thereinto;

said watertight container further comprising at ground level a top having a solar energizable heat sink;

said heat sink including heat conductors which extend downward into the water inside the watertight container for transforming the water into a mist;

said watertight container further comprising a pipe near its top connected to the means for connecting a pipe to the grounding electrode for conducting moisture to the grounding electrode.

4. The grounding system of claim 3, wherein the underground solar humidifier further comprises a water level sensor for indicating the need to add water to the watertight container of the underground solar humidifier.

* * * * *